US009848640B2

(12) United States Patent
Pilzecker

(10) Patent No.: US 9,848,640 B2
(45) Date of Patent: Dec. 26, 2017

(54) EASY-OPENING RECLOSE SYSTEMS FOR CIGARETTE PACKAGING

(71) Applicant: Amcor Flexibles, Kreuzlingen (CH)

(72) Inventor: Jens Pilzecker, Bückeburg (DE)

(73) Assignee: Amcor Flexibles, Kreuzlingen (CH)

( * ) Notice: Subject to any disclaimer, the term of this patent is extended or adjusted under 35 U.S.C. 154(b) by 13 days.

(21) Appl. No.: 14/769,362

(22) PCT Filed: Feb. 21, 2014

(86) PCT No.: PCT/EP2014/053447

§ 371 (c)(1),
(2) Date: Aug. 20, 2015

(87) PCT Pub. No.: WO2014/128264

PCT Pub. Date: Aug. 28, 2014

(65) Prior Publication Data

US 2015/0374033 A1 Dec. 31, 2015

(30) Foreign Application Priority Data

Feb. 22, 2013 (EP) ..... 13156409

(51) Int. Cl.
*B65D 77/00* (2006.01)
*A24F 15/12* (2006.01)
(Continued)

(52) U.S. Cl.
CPC ..... *A24F 15/12* (2013.01); *B65D 75/5833* (2013.01); *B65D 85/1018* (2013.01); *B65D 2575/586* (2013.01)

(58) Field of Classification Search
USPC ..... 206/264, 265, 268, 271, 273
See application file for complete search history.

(56) References Cited

U.S. PATENT DOCUMENTS 3,265,287 A * 8/1966 Hovland ..... B65D 75/26 206/245
3,298,590 A * 1/1967 Gray ..... B65D 83/02 206/264

(Continued)

FOREIGN PATENT DOCUMENTS

EP 1 449 789 A1 8/2004
WO WO 98/22367 A1 5/1998

(Continued)

*Primary Examiner* — Jacob K Ackun
(74) *Attorney, Agent, or Firm* — Reinhart Boerner Van Deuren P.C.

(57) ABSTRACT

The present invention discloses a reclosable pack (1) of smoking articles, said pack comprising a sealed enclosure having a front wall, a back wall, two side walls (7), a top-end wall (8) and a bottom-end wall (6), said enclosure comprising a flexible packaging laminate around a bundle of smoking articles (2), the laminate comprising a built-in easy-opening access, said laminate comprising a permanently tacky adhesive layer (3) sandwiched between an inner layer structure (9) and an outer layer structure (12) comprising an outer score line (13) formed through the thickness of the outer layer structure (12) and an inner score line (14) formed through the thickness of the inner layer structure (9), both delimiting separable opening portions, in which a region of the outer opening portion between the outer and inner score lines (13, 14) is attached to an underlying surface of the inner layer structure (9) via a permanently tacky adhesive (3), the outer opening portion being peelable from the underlying surface of the inner layer structure (9) to build an opening flap (4), and the outer opening portion being re-attachable to the underlying surface of the inner layer structure (9) via said permanently tacky adhesive (3) for reclosing, in use, the opening access, wherein said opening access is exclusively located at the top-end wall (8) of the sealed enclosure.

11 Claims, 3 Drawing Sheets

(51) Int. Cl.
*B65D 75/58* (2006.01)
*B65D 85/10* (2006.01)

(56) References Cited

U.S. PATENT DOCUMENTS

| | | | | | |
|---|---|---|---|---|---|
| RE26,712 | E | * | 11/1969 | Whitaker et al. | B65D 5/701 206/264 |
| 3,897,900 | A | * | 8/1975 | Gorski | B65D 5/701 206/264 |
| 3,923,239 | A | * | 12/1975 | Lee | B65D 85/1009 206/250 |
| 4,465,185 | A | * | 8/1984 | Sur | B65D 85/1027 206/264 |
| 4,610,357 | A | | 9/1986 | Nakamura | |
| 4,709,811 | A | * | 12/1987 | Shimada | B65D 85/1009 206/254 |
| 6,505,735 | B1 | * | 1/2003 | Parker | B65D 75/5838 206/265 |

FOREIGN PATENT DOCUMENTS

| | | | |
|---|---|---|---|
| WO | WO 00/03937 | A1 | 1/2000 |
| WO | WO 01/89962 | A1 | 11/2001 |
| WO | WO 02/066341 | A1 | 8/2002 |
| WO | WO 2005/123535 | A1 | 12/2005 |
| WO | WO 2008/062159 | A1 | 5/2008 |
| WO | WO 2008/115693 | A1 | 9/2008 |
| WO | WO 2011/009520 | A1 | 1/2011 |
| WO | WO 2011/110272 | A1 | 9/2011 |

* cited by examiner

EASY-OPENING RECLOSE SYSTEMS FOR CIGARETTE PACKAGING

FIELD OF THE INVENTION

The present invention is related to an easy opening and reclose system for cigarette packs, in particular for inner liner of rigid cigarette boxes or for cigarette packs of flexible films called soft packs.

STATE OF THE ART

Numerous opening and reclose systems for inner liner of cigarette boxes or cigarette soft packs exist today on the market. Documents related to such systems are notably WO 2011/089962 A1 (BAT), WO 2008/062159 A1 (BAT) and WO 2011/110272 A1 (Focke).

WO 98/22367 A1 (BAT) discloses a soft pack of smoking articles with inner stiffening frame comprising a sealed enclosure of a barrier layer around a bundle of cigarettes, an aperture in the top-end wall of the barrier layer, a cover layer over the aperture with a permanently tacky undersurface in order to reseal the aperture by the application of said undersurface on the barrier layer.

WO 2001/089962 A1 (BAT) discloses a soft pack without inner stiffening frame and a sealed enclosure of a barrier material with an aperture that is reclosable with a resealable cover layer having a pull tab. A sheet-material wrap is disposed exteriorly of said enclosure and over the cover layer. For the first opening of the aperture, the wrap needs to be torn or removed.

Laminates and methods for the production of said laminates that are suitable for the manufacturing of the above-mentioned packs are mentioned in WO 2008/115693 A1 (Wrigley), WO 2008/115693 A1 (Wrigley), WO 2005/123535 A1 (Sonoco), WO 02/066341 (BAT), EP 1 449 789 (Alcan) and U.S. Pat. No. 4,610,357 (Nakamura).

These documents disclose flexible packaging laminates having a built-in opening and reclose feature, generally comprising a permanently tacky adhesive or a permanently tacky label to reclose the pack. A peripheral tacky region is generally attached to an underlying surface, the outer opening portion generally being peelable from an underlying surface. The opening access always extends over the top-end wall and front wall of the cigarette box.

Each of the above-mentioned packaging's and laminates has its specific advantages and drawbacks and there is still a need for improvement of the easy opening and reclose systems of cigarette packs.

AIM OF THE INVENTION

The present invention aims to provide an easy opening and reclose system for cigarette packs with an exclusive opening at the top of the pack, and in particular a built-in easy-opening access obtained by the use of a specific laminate comprising specifically-positioned score lines that are able to generate a flap with a permanently tacky adhesive on its periphery.

SUMMARY OF THE INVENTION

The present invention discloses a reclosable pack of smoking articles, said pack comprising a sealed enclosure having a front wall, a back wall, two side walls, a top-end wall and a bottom-end wall, said enclosure comprising a flexible packaging laminate around a bundle of smoking articles, the laminate comprising a built-in easy-opening access, said laminate comprising a permanently tacky adhesive layer sandwiched between an inner layer structure and an outer layer structure, said structures comprising an outer score line formed through the thickness of the outer layer structure and an inner score line formed through the thickness of the inner layer structure, both delimiting separable opening portions, in which a region of the outer opening portion between the outer score line and the inner score line is attached to an underlying surface of the inner layer structure via a permanently tacky adhesive, the outer opening portion being peelable from the underlying surface of the inner layer structure to build an opening flap, and the outer opening portion being re-attachable to the underlying surface of the inner structure via said permanently tacky adhesive for reclosing, in use, the opening access, wherein said opening access is exclusively located at the top-end wall of the sealed enclosure.

Preferred embodiments of the present invention disclose at least one, or an appropriate combination, of the following features:

- in use, the permanently tacky adhesive remains located on the underlying surface of the inner structure after it is peeled from the underlying surface;
- the permanently tacky adhesive layer is patterned and located on the surface delimited by the outer score line and the inner score line;
- the flexible packaging laminate comprises a layer of a permanently adhesive extending over the entire surface of the laminate;
- the flexible packaging laminate comprises a release layer between the patterned, permanently tacky adhesive layer and the permanent adhesive;
- the release layer extends over the entire surface of the laminate;
- the flexible packaging laminate further comprises an opaque layer, located between the inner and outer structures, the depth of the first and second score lines being limited by said opaque layer;
- the opaque layer is the release layer, the permanent laminating adhesive layer, an aluminium layer or a printed layer;
- the adhesion at 20° C. between the permanently tacky adhesive layer and said enclosure is comprised between 1 and 10 N/15 mm, preferably between 1 and 5 N/15 mm, and most preferably between 2 and 3 N/15 mm according to test method FINAT N°2;
- the adhesion at 20° C. between the permanently tacky adhesive layer and the inner structure is at least 2 N/15 mm stronger than the adhesion between the permanently tacky adhesive layer and the outer structure;
- the sealed enclosure is an inner liner of a carton box.

SHORT DESCRIPTION OF THE DRAWINGS

LIST OF REFERENCE SYMBOLS

Figure 1:
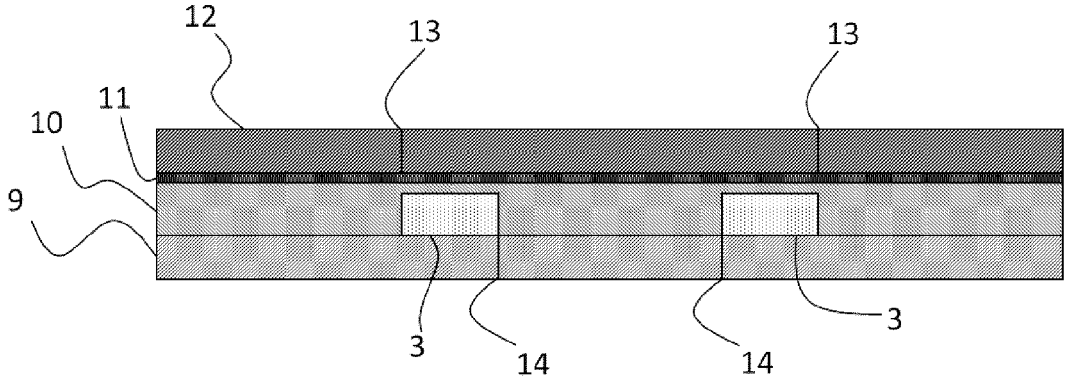
FIG. 1 represents a cross-section of the liner with an easy opening and reclose system in the closed position.
Figure 2:
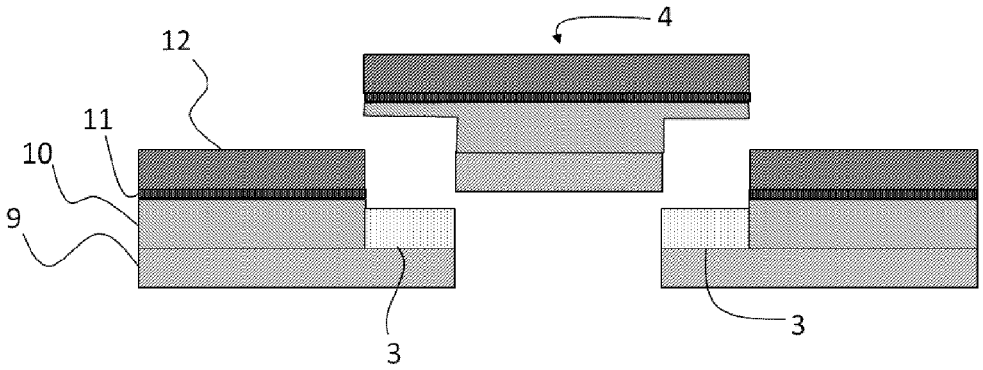
FIG. 2 represents a cross-section of the liner with an easy opening and reclose system in the open position, after the peel operation with a generated flap.
Figure 3:
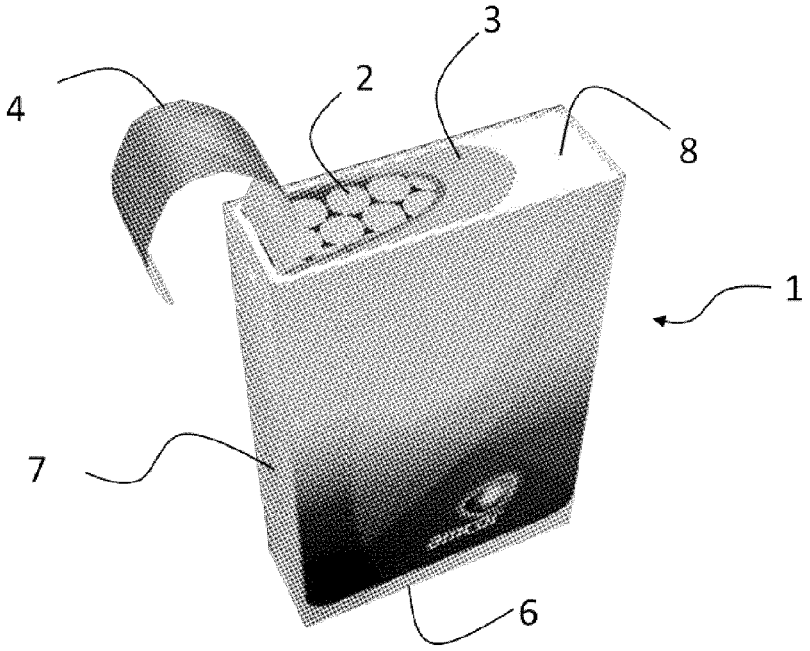
FIG. 3 represents a cigarette packaging according to the invention with an asymmetric opening access exclusively situated on the top of the pack.
Figure 4:
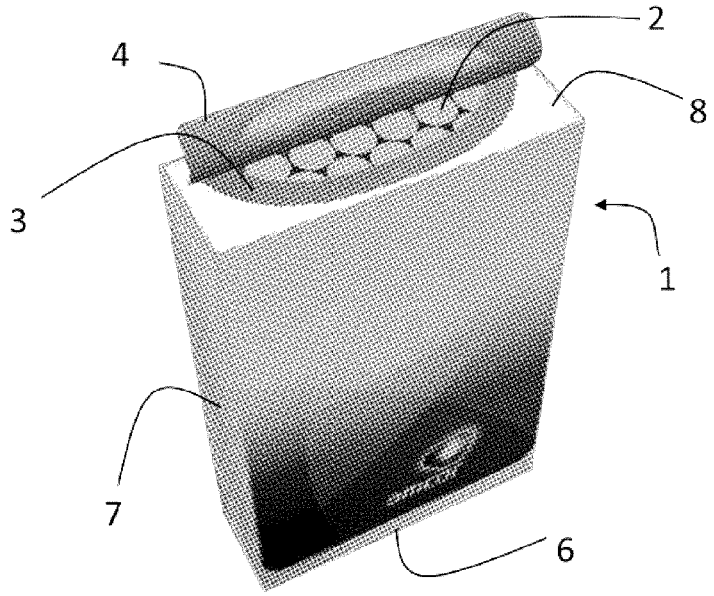
FIG. 4 represents a cigarette packaging according to the invention with a symmetric opening access exclusively situated on the top of the pack.
Figure 5:
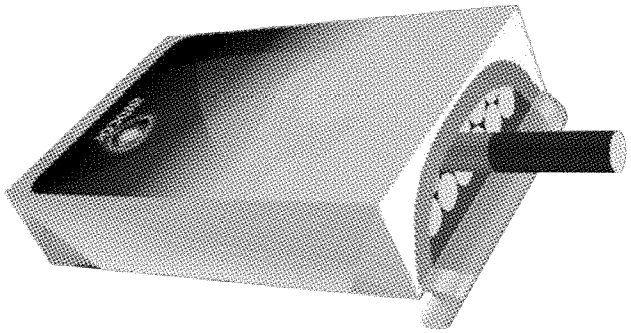
FIG. 5 represents the cigarette packaging of FIG. 4 with a partially-extracted cigarette.

1. Reclosable pack
2. Smoking article
3. Permanently tacky adhesive layer
4. Enclosure flap
5. Carton box
6. Bottom wall
7. Side wall
8. Top wall
9. Inner structure
10. Over-lacquer or release layer
11. Permanent laminating adhesive
12. Outer structure
13. Outer score line
14. Inner score line

DETAILED DESCRIPTION OF THE INVENTION

The present invention is related to a reclosable pack 1 of smoking articles 2, the pack comprising a sealed enclosure of a flexible packaging laminate around a bundle of smoking articles 2, the laminate having a built-in easy-opening access. The built-in easy-opening access is advantageously and exclusively located at the top-end wall 8 of the sealed enclosure. This particular location prevents the folding of the built-in easy-opening access system at the production and filling stages of the pack 1. The folding of the easy-opening access is a weak point in the production chain and can induce premature opening and a shorter shelf-life of the content.

The built-in easy-opening access has the form of a partially self-adhesive flap 4, said aperture comprising on its edges a permanently tacky adhesive (PTA) layer 3. A permanently tacky adhesive is often called a pressure-sensitive adhesive (PSA). In the following description, both expressions are considered as equivalent. The location of the permanently tacky adhesive layer 3 on the edges of the flap 4, or preferably on the underlying surface, prevents that the user, when manipulating the enclosure flap 4, contaminates the adhesive 3 with his fingers, which progressively reduces the adhesion upon reclosing. Furthermore, a preferred location of the PTA on the underlying surface prevents any possible contact between the adhesive 3 and the smoking articles 2. Such contact could potentially contaminate the smoking article 2 with adhesive residue, rendering the smoking article sticky, which produces an unpleasant contact with the lips of the user.

The flexible packaging laminate used for the reclosable pack 1 of the present invention is preferably a laminate of an inner structure 9 and an outer structure 12 that are laminated to one another. Each of both structures can be a single layer (such as a single polymeric sheet material) or can include a laminate of a multiple-layer structure of two of more layers. It can also be a coextruded structure. Both structures can further include printed indicia as appropriate for a particular downstream packaging application.

The permanently tacky adhesive 3 (PTA) can be pattern-applied (for example in the shape of a U) to any of both structures. The PTA pattern is then preferably covered with an over-lacquer layer 10. The over-lacquer layer 10 adheres to both the PTA layer 3 and the uncovered surface, and works as a protective or release layer so that the structure with the PTA can be stored on a roll without any blocking effect. Examples of the over-lacquer layer 10 include nitrocellulose materials or combinations of nitrocellulose materials with an anti-blocking agent such as silica, and water-based acrylic resins.

The over-lacquer layer 10 can be applied only on the PSA/PTA layer or can advantageously be applied across the entire surface of the structure. In this latter case, the over-lacquer layer 10 has preferably a variable thickness, smoothing out the thickness variability induced by the patterned PTA. For example, the over lacquer 10 is applied in a liquid state by using an appropriate solvent, such as water in the case of water-based acrylic resins.

A layer of permanent adhesive 11 is then applied across the entire surface of the structure (also referred to as "continuous" or "full" coverage) to cover the PTA, over-lacquer layer 10 (if any) and the possibly uncovered inner or outer structure. Alternatively, a layer of the permanent adhesive 11 can be applied across the entire surface of any of both structures.

By "permanent adhesive" 11 is meant an adhesive that is usually used in a lamination process for obtaining permanent adhesion as opposed to peelable adhesive.

The inner and outer structures are directed into an opposing face-to-face relationship so that the pattern-applied PTA 3, over-lacquer layer 10, and full-coverage permanent adhesive layer 11 are sandwiched between the inner and outer structures. The permanent adhesive 11 adheres to the over-lacquer layer 10 and joins the inner and outer structures to one another to form the flexible packaging laminate.

When the PTA 3 is covered by the over-lacquer layer 10, the structure with the pattern-applied PTA 3 and over-lacquer layer 10 (for example the inner structure) can be rolled and stored on a roll without blocking effect, and subsequently laminated to a second structure (for example the inner structure) with the permanent adhesive in a separate process step. Alternatively, both structures can be laminated to one another in an integrated (in-line) process.

To form the built-in open and reclose structure in the flexible packaging laminate according to the invention, an outer and an inner offset score lines (13, 14) are performed in the inner and outer structures (9, 12), respectively to form an integrated flap 4 that can be lifted out of the plane of the laminate to form the opening access. The opening then allows access to the product enclosed by the reclosable package 1 formed by the flexible packaging laminate.

In particular, a first inner score line 14 is formed in the inner structure 9 that will form the inner surface of the resulting package. The first inner score line 14 defines an inner opening surface corresponding to the inner surface of the flap 4 and forms the opening in the laminate when the flap 4 is detached therefrom. The inner score line 14 is generally delineated along the inner periphery of the PTA pattern.

A second outer score line 13 offset from the inner score line 14 is formed in the outer structure 12 that will form the outer surface of the resulting reclosable package according to the invention. The outer score line 13 defines an outer closing surface corresponding to the outer surface of the flap 4 once it is detached from the laminate. The outer score line 13 is generally delineated along the outer periphery of the PTA pattern.

The location of the outer score line 13 (offset) is positioned so that the outer closing surface of the flap includes an edge region extending beyond the outer edge of the underlying inner opening surface of the flap 4. The pattern-applied PTA is accordingly located in the edge region between the inner and outer score lines. The permanent adhesive 11 joins the inner and outer structures except in this edge region between both score lines (13, 14).

When the flap 4 is lifted out of the plane of the laminate, the inner structure 9 is separated at the inner score line 14 and the outer structure 12 is separated at the outer score line 13. Because the permanent adhesive 11 permanently joins the inner opening surface of the inner structure 9 to the outer closing surface of the outer structure 12, lifting the flap 4 forms the opening access in the laminate. The flap 4 can be reclosed by returning it to its original position in the plane of the laminate. The edge region of the outer closing surface of the flap 4 is reattached to an underlying portion of the inner structure 9 via the PTA 3 located in this edge region. The PTA remains on the underlying portion even after the flap is peeled off.

The offset score lines (13, 14) are advantageously performed by laser scoring, the depth of the scoring being preferably limited by an opaque layer. The opaque layer can be diffusive of reflective, such as a layer comprising whitening filler such as $TiO_2$, a printed layer, or metallic layer such as an aluminum layer. By "printed layer" is meant a layer comprising opaque ink.

Non-limitative examples of typical film structures to be used in the invention are, from outer to inner layers:

- Outer lacquer/printing layer/OPP 30 μm/permanently tacky adhesive (PTA) 3 μm/permanent adhesive 3 μm/metalized OPP 45 μm.
- Outer lacquer/printing layer/OPP 30 μm/permanently tacky adhesive (PTA) 3 μm/release lacquer/permanent adhesive 3 μm/metalized OPP 45 μm.
- Outer lacquer/printing layer/PET 18 μm/permanently tacky adhesive (PTA) 3 μm/permanent adhesive 3 μm/metalized PET 18 μm.

The invention claimed is:

1. A reclosable pack of smoking articles, said pack comprising a sealed enclosure having a front wall, a back wall, two side walls, a top-end wall and a bottom-end wall, said enclosure comprising a flexible packaging laminate around a bundle of smoking articles, the laminate comprising a built-in easy-opening access, said laminate consisting of an inner and outer layer structures laminated to one another face-to-face via a layer of a permanent adhesive extending over an entirety of a region between said outer and inner layer structures which is bound by outer peripheral edges of the inner and outer layer structures, further comprising a permanently tacky adhesive layer sandwiched between the inner layer structure and the outer layer structure, said structures comprising an outer score line formed through the thickness of the outer layer structure and an inner score line formed through the thickness of the inner layer structure, both delimiting separable opening portions, in which a region of the outer opening portion between the outer and inner score lines is attached to an underlying surface of the inner layer structure via a permanently tacky adhesive, the permanently tacky adhesive layer is patterned and located on the surface delimited by the outer score line and the inner score line, the outer opening portion being peelable from the underlying surface of the inner layer structure to build an opening flap, and the outer opening portion being re-attachable to the underlying surface of the inner structure via said permanently tacky adhesive for reclosing, in use, the opening access, wherein said opening access is exclusively located at the top-end wall of the sealed enclosure.

2. The pack according to claim 1, wherein the permanently tacky adhesive, in use, remains located on the underlying surface of the inner structure after being peeled from the underlying surface.

3. The pack according to claim 1, wherein said pack comprises a release layer between the patterned, permanently tacky adhesive layer and the permanent adhesive.

4. The pack according to claim 3, wherein the release layer extends over the entire surface of the laminate.

5. The pack according to claim 4, wherein the flexible packaging laminate further comprises an opaque layer located between the inner structure and the outer structure, the depth of the first and second score lines being limited by said opaque layer.

6. The pack according to claim 5, wherein the opaque layer is the release layer, the permanent laminating adhesive layer, an aluminium layer or a printed layer.

7. The pack according to claim 1, wherein the adhesion at 20° C. between the permanently tacky adhesive layer and said enclosure is comprised between 1 and 10 N/15 mm according to test method FINAT N°2 as published by FINAT February 2013.

8. The pack according to claim 1, wherein the adhesion at 20° C. between the permanently tacky adhesive layer and the inner structure is at least 2 N/15 mm stronger than the adhesion between the permanently tacky adhesive layer and the outer structure.

9. The pack according to claim 1, wherein the sealed enclosure is an inner liner of a carton box.

10. The pack according to claim 1, wherein the adhesion at 20° C. between the permanently tacky adhesive layer and said enclosure is comprised between 1 and 5 N/15 mm according to test method FINAT N°2 as published by FINAT February 2013.

11. The pack according to claim 1, wherein the adhesion at 20° C. between the permanently tacky adhesive layer and said enclosure is comprised between 2 and 3 N/15 mm according to test method FINAT N°2 as published by FINAT February 2013.

* * * * *